US006733113B2

(12) United States Patent
Yoshizawa et al.

(10) Patent No.: US 6,733,113 B2
(45) Date of Patent: May 11, 2004

(54) INK-JET RECORDING METHOD AND INK-JET RECORDING APPARATUS

(75) Inventors: Tomomi Yoshizawa, Tokyo (JP); Yasuhiko Kawashima, Saitama (JP); Hirotaka Iijima, Tokyo (JP); Kenichi Ohkubo, Tokyo (JP)

(73) Assignee: Konica Corporation, Tokyo (JP)

( * ) Notice: Subject to any disclaimer, the term of this patent is extended or adjusted under 35 U.S.C. 154(b) by 44 days.

(21) Appl. No.: 10/108,805

(22) Filed: Mar. 26, 2002

(65) Prior Publication Data

US 2003/0043238 A1 Mar. 6, 2003

(30) Foreign Application Priority Data

Mar. 30, 2001 (JP) ..... 2001-100079

(51) Int. Cl.[7] ..... B41J 2/045
(52) U.S. Cl. ..... 347/68
(58) Field of Search ..... 347/54, 68–70, 347/95, 100; 106/31.13, 31.28, 31.6

(56) References Cited

U.S. PATENT DOCUMENTS 4,203,025 A * 5/1980 Nakatani et al. ..... 219/216
4,859,344 A * 8/1989 Spangle et al. ..... 210/683
5,396,274 A * 3/1995 Ortquist et al. ..... 347/78
5,637,138 A * 6/1997 Yamazaki ..... 106/31.32
5,666,140 A * 9/1997 Mitani et al. ..... 347/12
5,680,163 A * 10/1997 Sugahara ..... 347/71
6,524,383 B2 * 2/2003 Komatsu et al. ..... 106/493
6,540,346 B1 * 4/2003 Akahira et al. ..... 347/107

* cited by examiner

*Primary Examiner*—Stephen Meier
*Assistant Examiner*—An H. Do
(74) *Attorney, Agent, or Firm*—Squire, Sanders & Dempsey

(57) ABSTRACT

An ink-jet recording method of forming an image with an ink-jet head, wherein the ink-jet head includes an ink chamber, an electric actuator provided in the ink chamber and an insulating layer covering the electric actuator, including steps of: feeding an ink containing a coloring material and a water-soluble solvent into ink chamber, and applying a driving voltage with a driving frequency of 10 kHz to 55 kHz onto the electric actuator so that the ink is jetted from the ink chamber so as to form the image; wherein the thickness of the insulating layer is 0.1 $\mu$m to 10 $\mu$m, and the concentration of oxygen dissolved in the ink is 4 ppm or less.

27 Claims, 1 Drawing Sheet

INK-JET RECORDING METHOD AND INK-JET RECORDING APPARATUS

FIELD OF THE INVENTION

The present invention relates to an image forming method in which recording is carried out by ejecting ink from an ink-jet recording head and an image forming apparatus, and specifically to an ink-jet recording method as well as an ink-jet recording apparatus which is driven at a high rate.

BACKGROUND OF THE INVENTION

In ink-jet recording, there are a system in which images are formed by continuously ejecting ink and varying the ejected direction of only ink droplets necessary for image formation, while utilizing an electrode arranged between the image recording body (the medium) and the ink head, and an on-demand type recording system in which ink droplets are ejected only as needed.

From the viewpoint of operating cost as well as simplicity of the unit, said on-demand type is more advantageous. Methods for applying pressure to ink in an ink chamber in the case of on-demand include a method in which pressure is applied to ink utilizing deformation of an element (being a piezo element) in the ink chamber, which is deformed when voltage is applied, and a method in which an electric current is applied to a heat-generating resistor so that ink volume is increased due to vaporization of ink components.

In recent years, the market has required high speed for ink-jet printing. Specifically, for the on-demand type, it has been demanded that printing be carried out by ejecting water-based ink at a high rate.

In order to achieve high speed printing, it is necessary that ink ejection frequency per unit time be increased by applying voltage to the electric actuator, such as an electrode or heat-generating resistor, at a high frequency. In order to meet market demand, driving frequency is preferably at least 15 kHz, is more preferably at least 20 kHz, and is further more preferably at least 30 kHz.

However, when the head is driven at such a high rate, the ejected ink rate tends to decrease during continuous ejection. When the ejected rate decreases, it is impossible to form highly detailed images due to an increase of fluctuation in the size of ink spreading as well as in the ink droplet-adhered position. Other than these, problems also occur in which the working life of the head is shortened due to the fact that the electrode or the electric circuit is damaged due to the high rate driving.

In an ink-jet printer in which ink is ejected while compressing the ink chamber utilizing a piezo element, it is effective that in order to efficiently use the ejection energy, said piezo element, in which the electrode is arranged, closely approaches said ink. When said piezo element is arranged to closely approach said ink, the electrode, which drives said piezo element, closely approaches said ink.

However, when the electrode comes into direct contact with the ink, the electrode, when voltage is applied, tends to erode. In order to minimize said erosion, an insulating layer can be provided between the electrode and the ink.

An increase in the thickness of said insulating layer hinders piezo motion resulting in energy loss.

On the other hand, there is an ink-jet recording apparatus having such a structure that by generating heat energy while applying voltage to a heat-generating resistor, air bubbles are generated in said ink so that ink is ejected. In said apparatus, also, in order to minimize erosion of the heat-generating resistor as well as the electrode, the heat-generating resistor and the electrode are covered with an insulating layer.

However, the use of the thin layer causes problems in which the working life of the electrode is shortened.

Accordingly, the market has increasingly been demanding that even in high speed recording, ejection rate be stabilized, heads exhibit sufficiently long working life, and running cost be not increased.

Japanese Patent Publication Open to Public Inspection No. 8-20738 describes that by adjusting the electric conductivity of ink to 1.0 mS/cm or less, electrode erosion is minimized and more stable printing is achieved.

However, when in order to realize high speed printing, the head is driven at a high rate, electrode degradation occurs even though the electrical conductivity is adjusted to said optimal range.

Japanese Patent Publication Open to Public Inspection No. 11-209670 describes that by employing an ink-jet printer in which the total dissolved gas concentration is adjusted to be 2,950 ppb or less, lack of ejected ink can be minimized.

However, said patent publication does not describe any head which is driven at a high rate.

SUMMARY OF THE INVENTION

An object of the present invention is to provide an ink-jet recording method, an ink-jet recording apparatus, and an ink-jet head capable of recording stable images at a high rate over an extended period of time.

The above objects of the present invention can be achieved by following structures.

[Structure 1]

An ink-jet recording method of forming an image with an ink-jet head, wherein the ink-jet head comprises an ink chamber, an electric actuator provided in the ink chamber and an insulating layer covering the electric actuator, comprising steps of:

feeding an ink containing a coloring material and a water-soluble solvent into ink chamber, and applying a driving voltage with a driving frequency of 10 kHz to 55 kHz onto the electric actuator so that the ink is jetted from the ink chamber so as to form the image;

wherein the thickness of the insulating layer is 0.1 $\mu$m to 10 $\mu$m, and the concentration of oxygen dissolved in the ink is 4 ppm or less.

[Structure 2]

The ink-jet recording method of Structure 1, wherein the electric actuator is an electrode.

[Structure 3]

The ink-jet recording method of Structure 2, wherein the ink chamber comprises a piezo element and the electrode is provided on the piezo element.

[Structure 4]

The ink-jet recording method of Structure 1, wherein the electric actuator is a heat-generating resistor.

[Structure 5]

The ink-jet recording method of Structure 1, wherein pH of said ink is 7 or more.

[Structure 6]

The ink-jet recording method of Structure 1, wherein said coloring material is a pigment.

[Structure 7]

The ink-jet recording method of Structure 1, wherein the sum of a concentration of sulfate ion, chloride ion and nitrate ion in said ink is 500 ppm or less.

[Structure 8]

The ink-jet recording method of Structure 1, wherein the sum of a concentration of sodium ion and potassium ion in said ink is 500 ppm or less.

[Structure 9]

The ink-jet recording method of Structure 1, wherein said driving frequency is 20 kHz or more.

[Structure 10]

The ink-jet recording method of Structure 9, wherein said driving frequency is 30 kHz or more.

[Structure 11]

The ink-jet recording method of Structure 1, wherein a surface tension of said ink is from 31 to 39 mN/m.

[Structure 12]

The ink-jet recording method of Structure 1, wherein the concentration of the dissolved oxygen in said ink is 2 ppm or less.

[Structure 13]

The ink-jet recording method of Structure 1, wherein the concentration of the dissolved oxygen in said ink is 0.01 ppm or more.

[Structure 14]

The ink-jet recording method of Structure 1, wherein the thickness of said insulating layer is from 0.1 to 5 $\mu$m.

[Structure 15]

An ink-jet recording apparatus for forming an image, comprising:

an ink accommodating section having an ink chamber, an electric actuator provided in the ink chamber, and an insulating layer covering the electric actuator, wherein the thickness of the insulating layer is 0.1 $\mu$m to 10 $\mu$m;

a driving section to apply a driving voltage onto the electric actuator with a driving frequency of 10 kHz to 55 kHz so that an ink is jetted from the ink chamber so as to form the image, and an ink feeding section to feed the ink into the ink chamber, wherein the ink contains a coloring material and a water-soluble solvent and the concentration of oxygen dissolved in the ink is 4 ppm or less.

[Structure 16]

The ink-jet recording apparatus of Structure 15, wherein the electric actuator is an electrode.

[Structure 17]

The ink-jet recording method of Structure 16, wherein the ink chamber comprises a piezo element and the electrode is provided on the piezo element.

[Structure 18]

The ink-jet recording apparatus of Structure 15, wherein the electric actuator is a heat-generating resistor.

[Structure 19]

The ink-jet recording apparatus of Structure 15, wherein pH of said ink is 7 or more.

[Structure 20]

The ink-jet recording apparatus of Structure 15, wherein said coloring material is a pigment.

[Structure 21]

The ink-jet recording apparatus of Structure 15, wherein the sum of a concentration of sulfate ion, chloride ion and nitrate ion in said ink is 500 ppm or less.

[Structure 22]

The ink-jet recording apparatus of Structure 15, wherein the sum of a concentration of sodium ion and potassium ion in said ink is 500 ppm or less.

[Structure 23]

The ink-jet recording apparatus of Structure 15, wherein said driving frequency is 20 kHz or more.

[Structure 24]

The ink-jet recording apparatus of Structure 23, wherein said driving frequency is 30 kHz or more.

[Structure 25]

The ink-jet recording method of Structure 15, wherein a surface tension of said ink is from 31 to 39 mN/m.

[Structure 26]

The ink-jet recording apparatus of Structure 15, wherein the concentration of the dissolved oxygen in said ink is 2 ppm or less.

[Structure 27]

The ink-jet recording apparatus of Structure 15, wherein the concentration of the dissolved oxygen of said ink is 0.01 ppm or more.

[Structure 28]

The ink-jet recording apparatus of Structure 15, wherein the thickness of said insulating layer is from 0.1 to 5 $\mu$m.

DETAILED DESCRIPTION OF THE INVENTION

Figure 1:
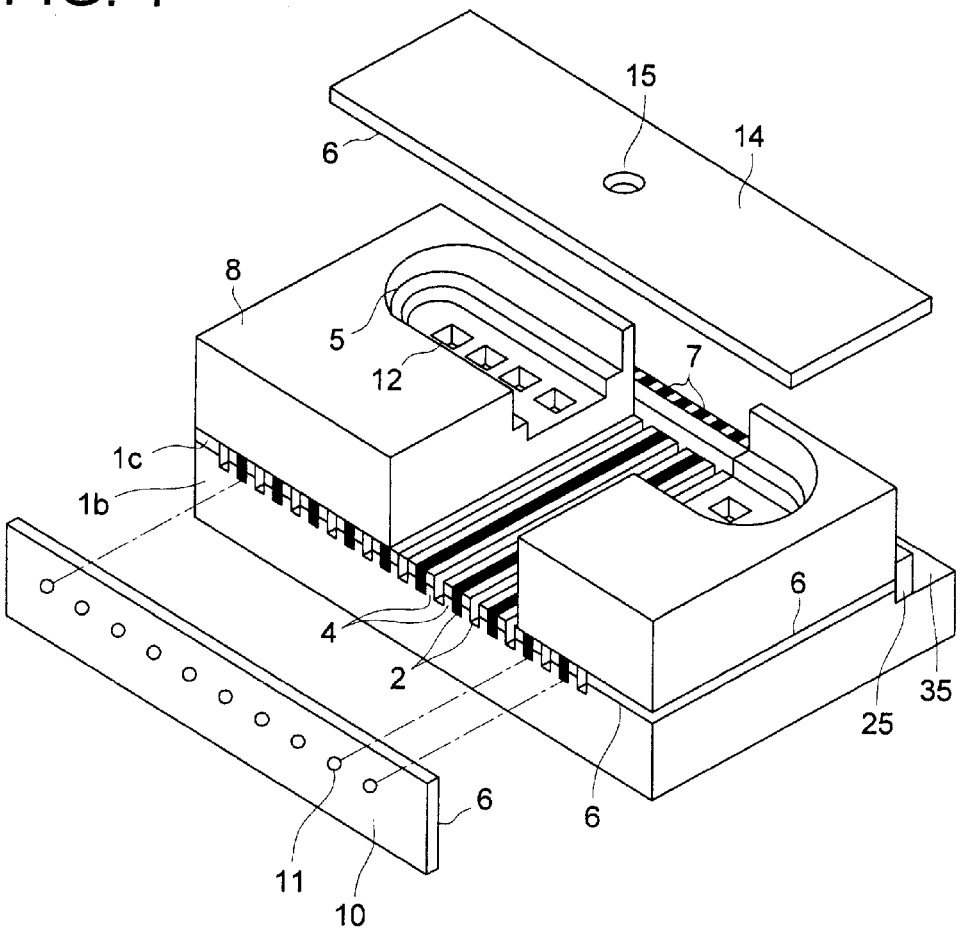
FIG. 1 is a schematic view showing one section of the recording head employed in the present invention.

The present invention will now be detailed.

In order to apply voltage to a piezo element, the electrode employed in the present invention is provided on the surface of said piezo element. Said electrode may be formed employing layer-forming methods, known in the art, such as sputtering in which a conductive layer comprised of, for example, Al, Ta, and gold, is formed. For example, an electrode is formed by depositing a 150 nm thick Ta layer in the interior of an ink chamber in an ink-jet recording head, employing said sputtering method.

Further, in an apparatus having such a structure that ink is ejected utilizing air bubbles which are formed in said ink employing energy generated by a heat-generating resistor, said heat-generating resistor is formed on a substrate comprised of, for example glass, ceramic and plastic. As said heat-generating resistor, a layer comprised of alloy such as NiCr, metallic borides such as $HfB_2$, and Ir is formed at a thickness of, for example, approximately 0.2 $\mu$m, employing a high frequency (RF) sputtering method.

The insulating layer thickness of the present invention is commonly from 0.1 to 10 $\mu$m. However, from the viewpoint of the driving voltage-jetting energy responsiveness at a high rate operation as well as the durability of electrode, said thickness is preferably from 0.1 to 5 $\mu$m, and is more preferably from 0.3 to 2 $\mu$m.

The insulating layers used in the present invention are explained below.

(1) Coating of Plastics

There are methods for coating a solution comprising thermoplastic resins such as polyimide resins, acrylic resins, aramide resins, polyimide resins, and styrol resins, and thermosetting resins such as epoxy resins, phenoxy resins, urethane resins, nylons, silicone resins, fluorosilicone resins, phenol resins, melamine resins, xylene resins, alkyd resins, and thermosetting acrylic resins (2) Vacuum Evaporation of Metal Oxides, Nitrides, and Sulfides Metal oxides ($SiO_2$, SiO, CrO, and $Al_2O_3$), metal nitrides ($Si_3N_4$ and AlN), metal sulfides (ZnS), or alloy thereof, are coated employing vacuum evaporation or sputtering. Further, plastics described in (1) may be coated employing sputtering. Parylene resins may be vacuum-evaporated. Of these, $Al_2O_3$ as well as $Si_3N_4$ exhibits excellent desired effects.

(3) Coating of Hydrocarbons

Any of the hydrocarbons such as Group VI element-containing hydrocarbons firstly represented by oxygen-containing hydrocarbons and sulfur-containing hydrocarbons; nitrogen-containing hydrocarbons; silicon-containing hydrocarbons; halogen-containing hydrocarbons firstly represented by fluorine-containing hydrocarbons; and Group III element containing hydrocarbons may be coated utilizing P-CVD (plasma chemical vacuum deposition) and then subjected to an overcoat treatment. Alternatively, coating may be carried out utilizing said P-CVD in a mixed gas phase of those. Of those described above, fluorine-containing hydrocarbons exhibit excellent results. Incidentally, depending on compatibility in terms of adhesive properties, these layers will be required to be suitably provided with an undercoat such as a-SiC and a-SiN.

Of (1) through (3), a layer comprised of Parylene (the trade name, manufactured by Tomoe Kogyo Co.) is preferably formed employing a CVD method.

A Parylene layer can be formed employing a CVD method in which solid diparaxylylene dimer is utilized as a vacuum evaporation source. Namely, said diparaxylylene dimer is evaporated and a paraxylylene monomer, which is a stable radical formed through thermal decomposition, is adsorbed on a substrate to undergo polymerization, whereby a layer is formed.

The concentration of dissolved oxygen of the ink employed in the present invention is commonly less than or equal to 4 ppm by weight, is preferably less than or equal to 2 ppm by weight, and is more preferably from 0.01 to 2 ppm by weight. In order to adjust the concentration of dissolved oxygen to said range, there are, for example, a method in which an ink placed in a vessel is stirred upon reducing the interior pressure, and a method in which external pressure is reduced while passing ink through a hollow fiber comprised of layers which can transmit gases. The concentration of dissolved oxygen, as described herein, refers to the value determined at 25° C., employing a dissolved oxygen meter. For example, measurement can be carried out employing, for example, dissolved oxygen meter DO-25A, manufactured by DKK TOA Corp.

By adjusting the concentration of the dissolved oxygen of the ink of the present invention to said range, it is possible during high speed operation to carry out stable ink ejection over an extended period of time without degrading responsivity of the electrode. In addition, when the pH of ink is more than or equal to 7, resultant effects are pronounced. Further, when the total ion concentration of Na and K contained in the ink is 500 ppm or less by weight, or when the total concentration of sulfate ions, chloride ions, and nitrate ions is 500 ppm or less by weight, the resultant effects are more pronounced. Method for adjusting the concentration of sodium ions, potassium ions, sulfate ions, chloride ions, and nitrate ions:

An aqueous colorant solution or an aqueous colorant dispersion, having a specified concentration, is measured employing an atomic absorption photometer. Subsequently, ion concentration in an ink state is calculated in terms of concentration of the colorant used in ink. Either a distilled water or an ion-exchanged water may be used. Based on the obtained results, it is possible to estimate the desired ion concentration.

Subsequently, ink is prepared by adding other additives, and said ion concentration in the resultant ink is determined employing an atomic absorption photometer. When the resultant ion concentration exceeds the target value, said ion concentration can be decreased by passing said aqueous colorant solution or aqueous colorant dispersion through ion exchange resins. Said ion concentration can be decreased by carrying out repeated ion exchange. When the desired ion concentration is not obtained even employing said ion exchange, the same treatment can be applied to additives other than the colorant.

Listed as colorants employed in the ink used in the present invention are, for example, pigments, dispersive dyes, acidic dyes, direct dyes, basic dyes, and reactive dyes, or food dyes.

Employed as dyes usable in the present invention may be any of those known in the art. Representative dyes are listed below. However, the present invention is not limited to these examples.

<Direct Dyes>

C.I. Direct Yellow 1, 4, 8, 11, 12, 24, 26, 27, 28, 33, 39, 44, 50, 58, 85, 86, 100, 110, 120, 132, 142, and 144;

C.I. Direct Red 1, 2, 4, 9, 11, 134, 17, 20, 23, 24, 28, 31, 33, 37, 39, 44, 47, 48, 51, 62, 63, 75, 79, 80, 81, 83, 89, 90, 94, 95, 99, 220, 224, 227 and 243;

C.I. Direct Blue 1, 2, 6, 8, 15, 22, 25, 71, 76, 78, 80, 86, 87, 90, 98, 106, 108, 120, 123, 163, 165, 192, 193, 194, 195, 196, 199, 200, 201, 202, 203, 207, 236, and 237; and C.I. Direct Black 2, 3, 7, 17, 19, 22, 32, 38, 51, 56, 62, 71, 74, 75, 77, 105, 108, 112, 117, and 154.

<Acidic Dyes>

C.I. Acid Yellow 2, 3, 7, 17, 19, 23, 25, 20, 38, 42, 49, 59, 61, 72, and 99;

C.I. Acid Orange 56 and 64;

C.I. Acid Red 1, 8, 14, 18, 26, 32, 37, 42, 52, 57, 72, 74, 80, 87, 115, 119, 131, 133, 134, 143, 154, 186, 249, 254, and 256;

C.I. Acid Violet 11, 34, and 75;

C.I. Acid Blue 1, 7, 9, 29, 87, 126, 138, 171, 175, 183, 234, 236, and 249;

C.I. Acid Green 9, 12, 19, 27, and 41; and

C.I. Acid Black 1, 2, 7, 24, 26. 48, 52, 58, 60, 94, 107, 109, 110, 119, 131, and 155

<Reactive Dyes>

C.I. Reactive Yellow 1, 2, 3, 14, 15, 17, 37, 42, 76, 95, 168, and 175;

C.I. Reactive Red 2, 6, 11, 21, 22, 23, 24, 33, 45, 111, 112, 114, 180, 218, 226, 228, and 235;

C.I. Reactive Blue 7, 14, 15, 18, 19, 21, 25, 38, 49, 72, 77, 176, 203, 220, 230, and 235;

C.I. Reactive Orange 5, 12, 13, 35, and 95;

C.I. Reactive Brown 7, 11, 33, 37, and 46;

C.I. Reactive Green 8 and 19;

C.I. Reactive Violet 2, 4, 6, 8, 21, 22, and 25; and

C.I. Reactive Black 5, 8, 31, and 39

<Basic Dyes>

C.I. Basic Yellow 11, 14, 21, and 32;

C.I. Basic Red 1, 2, 9, 12, and 13;

C.I. Basic Violet 3, 7, and 14; and

C.I. Basic Blue 3, 9, 24, and 25.

In addition to those cited above, also listed as dyes usable in the present invention may be chelate dyes and azo dyes which are employed in so-called silver dye bleach method light-sensitive materials (for example, Cibachrome, manufactured by Ciba-Geigy).

Chelate dyes are described, for example, in British Patent No. 1,077,484.

Azo dyes of said silver dye bleach method light-sensitive materials are described, for example, in British Patent Nos. 1,039,458, 1,004,957, and 1,077,628, and U.S. Pat. No. 2,612,448.

Employed as pigments usable in the present invention may be conventional organic and inorganic pigments, known in the art. Listed as examples are azo pigments such as azo lakes, insoluble azo pigments, condensed azo pigments, and chelate-azo pigments; polycyclic pigments such as phthalocyanine pigments, perylene and perylene pigments, anthraquinone pigments, quinacridone pigments, dioxazine pigments, thioindigo pigments, isoindolinone pigments, and quinophtharony pigments; dye lakes such as basic dye lakes and acidic dye lakes, organic pigments such as nitro pigments, nitoroso pigments, aniline black, and daylight fluorescence pigments; and inorganic pigments such as carbon black. Specific organic pigments are described below. Preferably employed pigments include:

C.I. Pigment Yellow 1, 3, 12, 13, 14, 16, 17, 43, 55, 74, 81, 83, 109, 110, and 128;

C.I. Pigment Orange 13, 16, 34, and 43;

C.I. Pigment Red 2, 5, 8, 12, 17, 22, 23, 41, 112, 114, 122, 123, 146, 148, 150, 166, 170, 220, 238, 245, and 258;

C.I. Pigment Violet 19 and 23;

C.I. Pigment Blue 15, 15:1, 15:3, 15:5, and 29;

C.I. Pigment Green 7 and 8;

C.I. Pigment Brown 1 and 7;

C.I. Pigment Black 1 and 7; and

C.I. Pigment White 6.

Water-soluble solvents employed in the present invention refer to solvents which exhibit a solubility of at least 1 percent (at 25° C.) in water, and include those shown below: alcohols (for example, methanol, ethanol, propanol, isopropanol, butanol, isobutanol, secondary butanol, tertiary butanol); polyhydric alcohols (for example, ethylene glycol, propylene glycol, 1,2-buranediol, 1,4-butanediol, 1,2-pentanediol, and thiodiglycol), polyhydric alcohol ethers (for example, as ethylene glycol monoethyl ether, ethylene glycol monophenyl ether, diethylene glycol monomethyl ether, diethylene glycol monoethyl ether, diethylene glycol dimethyl ether, propylene glycol monomethyl ether, dipropylene glycol monomethyl ether, ethylene glycol monomethyl ether acetate, triethylene glycol monomethyl ether, triethylene glycol monoethyl ether, triethylene glycol monobutyl ether, triethylene glycol dimethyl ether, tripropylene glycol dimethyl ether); amines (for example, ethanolamine, diethanolamine, triethanolamine, N-methyldiethanolamine, N-ethyldiethanolamine, morpholine, N-ethylmorpholine, ethylenediamine, diethylendiamine, triethylenetetramine, tetraethylenepentamine, polyethyleneimine, pentamethyldiethylenetriamine, and tatramethylpropylenediamine); amides (for example, formamide, N,N-dimethylformamide, and N,N-dimethylacetamide; heterocycles (for example, 2-pyrrolidone, N-methyl-2-pyrrolidone, N-cyclohexyl-2-pyrrrolidone, 2-oxazolidone, and 1,3-dimethyl-2-imldazolidinone); sulfoxides (for example, dimethylsulfoxide); sulfones (for example, sulfolane); sulfonate salts (for example, sodium 1-butanesulfonate); urea; acetonitrile; and acetone.

In the present invention, it is preferable that the water-soluble solvent comprises 50% or more of bivalent alcohol with respect to aging stability in tone of the ink. Of above water-soluble solvent, ethylene glycol and propylene glycol are especially preferable.

In the present invention, in order to adjust the surface tension of ink, surface active agents may be incorporated. Listed as surface active agents, preferably used in the ink of the present invention, are anionic surface active agents such as dialkyl sulfosuccinates, alkylnaphthalenesulfonates, and fatty acid salts; nonionic surface active agents such as polyoxyethylene alkyl ethers, polyoxyethylene alkyl allyl ethers, acetylene glycols, and polyoxyethylene-polyoxypropylene block copolymers; and cationic surface active agents such as alkylamine salts and quaternary ammonium salts. Of these, anionic surface active agents can be most preferably employed.

If desired, ink may comprise inorganic salts, surface active agents, pH regulators, hydrotropes, and dispersing agents.

In order to maintain storage stability over an extended period of time, antiseptic agents as well as antifungal agents may be incorporated into the ink. Listed as antiseptic agents, as well as antifungal agents, may be aromatic halogen compounds (for example, Prevento 1 CMK, manufactured by Bayer Co.), methylene dithiocyanate, halogen containing nitrogen sulfides, 1,2-benzisothiazoline-3-one (for example, Proxcel GXL, manufactured by Zeneca Pharmaceuticals). However, when the present invention is practiced, compounds are not limited to these described above.

In order to keep dyes in the ink stable, pH regulators may be added to said ink. Employed as pH regulators may be hydrochloric acid, acetic acid, citric acid, sodium hydroxide, and potassium hydroxide, which may be dissolved in water or diluted with water, or without any treatment at all. However, when the present invention is practiced, said pH regulates are not limited to these.

Hydrotropes may be added into the ink so that said ink at the nozzle tip is not dried. Preferably used as hydrotropes are urea and derivatives thereof.

When non-water-soluble dyes, such as dispersed dyes and pigments, are used in the ink employed in the present invention, said dyes are mixed with dispersing agents, with the medium, and with optional additives, and the resultant mixture may be dispersed employing a homogenizer. Employed as homogenizers may be ball mills, sand mills, line mills and high pressure homogenizers, all of which are known in the prior art.

Listed as preferred dispersing agents described above are, for example, formalin condensation products (for example, Demol C) of creosote oil and sodium sulfonate, formalin condensation products of sodium cresolesulfonate and sodium 2-naphthol-6-sulfonate, formalin condensation products of sodium phenolsulfonate, formalin condensation products of sodium β-naphtholsulfonate, formalin condensation products of sodium β-naphthalinesulfonate (for example, Demol N) and sodium β-naphtholsulfonate, and ligunin sulfonates (for example, Vanilex RN). In addition, listed as polymer dispersing agents may be styrene/acrylic acid copolymers, styrene/acrylic acid/acrylic acid ester copolymers, styrene/methacrylic acid copolymers, styrene/methacrylic acid/acrylic acid ester copolymers, styrene/maleic acid copolymers, styrene/maleic acid/acrylic acid ester copolymers, and polyvinyl alcohols.

The amount of dispersing agents used is preferably from 20 to 200 percent with respect to the dispersed dyes or pigments. When the amount of dispersing agents is less than the lower limit, the stability of the resultant dispersion is degraded due to an insufficient decrease in particle size. On the other hand, when said amount is more than the upper limit, the stability of the resultant dispersion is also degraded due to an insufficient decrease in particle size. In addition, an amount more than the upper limit is not preferred since the resultant viscosity increases. These dispersing agents may be employed individually or in combination.

Wetting agents, which are preferably employed for dispersion, include sodium dodecybenzenesulfonate, sodium 2-ethylhexylsulfosuccinate, sodium alkylnaphthalenesulfonate, ethylene oxide addition products of phenol, and ethylene oxide addition products of acetylenediol.

Depending upon the structure of used dispersed dyes and pigments, during dispersion, foaming or gelling occasionally occurs, and fluidity is also occasionally degraded. Therefore, it is necessary that dispersing agents, as well as wetting agents, are selected while taking into account wetting capability, dispersing capability, and dispersion stability, and in addition, foaming during dispersion, as well as gelling and fluidity of the resultant dispersion.

The nozzle diameter of nozzles of the recording head employed in the present invention is preferably in the range of 10 to 100 $\mu$m. The nozzle diameter, as described herein, refers to the diameter of the circle when the cross-section of the nozzle hole is circular and the diameter of the circle having the same area of the hole when the cross-section of the nozzle hole is not circular. The nozzle surface is preferably subjected to water-repellent finishing.

In the present invention, frequency (being the driving frequency) of voltage applied to the recording head is commonly in the range of 10 to 55 kHz, is preferably in the range of 20 to 50 kHz, and is more preferably in the range of 30 to 45 kHz.

EXAMPLES

Specific examples of the present invention will now be cited. However, the present invention is not limited to these examples.

A head in the ink-jet printer employed in the present invention will now be described with reference to FIGS. 1 and 2.

<Preparation of the Ink-Jet Head Used in the Present Invention.

Lower substrate 1*b* comprised of lead titanate zirconate as a piezo-electric material is adhered to upper substrate 1*b*, employing adhesive 6. Said lower substrate and said upper substrate are polarized in the reverse direction as shown by arrows in FIG. 2. A plurality of long narrow grooves is formed crossing said upper substrate and the lower substrate. By so doing, a plurality of parallel walls and grooves is formed.

Electrode 3 is provided on the interior surface of each of the plurality of grooves. After providing electrode 3 for groove 2, step 35 is formed by machining one portion of the upper surface of substrate 1. The surface of electrode 3 is coated with insulating layer 17 comprised of parylene in the thickness within the range of 0.1 to 10 $\mu$m, and the surface of insulating layer 17 is subjected to a hydrophilic treatment, utilizing an oxygen plasma treatment. Lid 8 is adhered onto the upper surface of wall 4, employing adhesive 6, and hole sealing piece 25 is adhered to the end surface of wall 4, employing an adhesive. Nozzle plate 10, having nozzle hole 11, is adhered to the end surface having an opening of groove 2, employing the same adhesive as above, and ink chamber 9 is formed in every other groove 2. A nozzle hole is provided corresponding to each ink chamber, namely it is provided alternating grooves 2. Common groove 5 is formed in the upper portion of lid 8 and hole 12 is formed so as to provide a path to each ink chamber. Alternating grooves 2 have both nozzle hole 11 and connecting path 12. Upper plate 14, having ink supply hole 15, is adhered, employing adhesive 6, onto the upper surface of lid 8 so as to cover the upper part of common groove 5.

Each electrode is connected to outgoing line 7 which is exposed on step 35 of lid 8.

Figure 2:
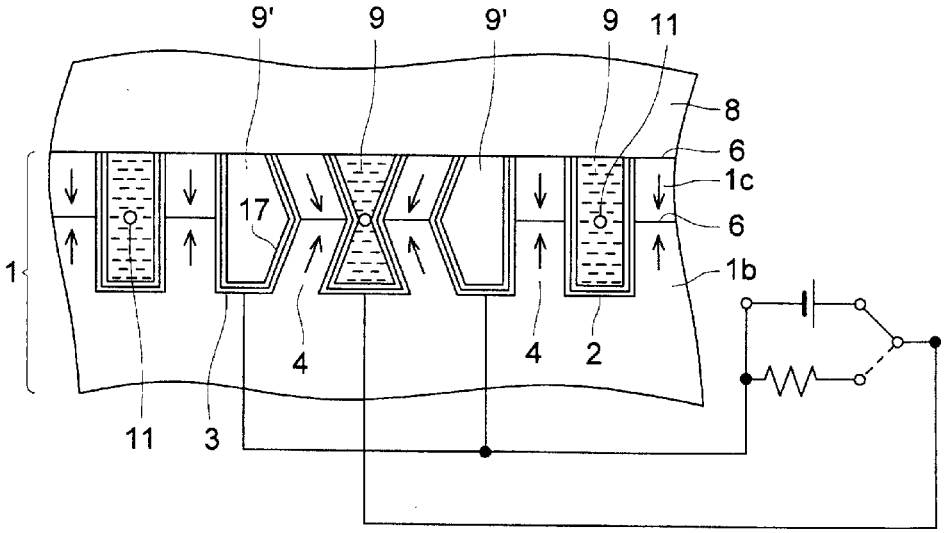
FIG. 2 is a schematic view showing one section of the recording head employed in the present invention.

Ink chamber 9, formed in every other groove 2 in series, as shown in FIGS. 1 and 2, is filled with ink which has been supplied from ink supply hole 15. Ink is not supplied to dummy grooves 9' adjacent to both sides.

Electrical signals are transmitted to outgoing line 7 and driving voltage is applied between the electrode layer of ink chamber 9 and the electrode layer of the dummy grooves on both sides so that the electric potential of the electrode layer of the ink chamber is increased. As a result, both sidewalls of ink chamber 9 are deformed inwardly, thereby contracting the ink chamber, causing ink to be ejected. Subsequently, when the electrode layer of the ink chamber is grounded, the resultant deformation is removed and the ink chamber is repeatedly filled with ink.

<Preparation of Ink-Jet Heads>

The ink-jet heads used in Examples 1 to 6 were prepared in the above-described preparing methods of ink-jet head of the present invention, provided that the thickness of each of the insulating layers were varied in 2.0 $\mu$m (for Example 1), 0.5 $\mu$m (for Examples 2 and 4), 1.0 $\mu$m (for Example 3) and 0.3 $\mu$m (for Examples 5 and 6), respectively.

The ink-jet heads used in Comparative Example was also prepared in the same manner as the above-described preparation method of the ink-jet head of the present invention, except that the thickness of the insulating layer was adjusted to 0.05 $\mu$m.

<Preparation of Ink>

(Magenta Pigment Dispersion)

| | |
|---|---|
| C.I. Pigment Red 122 | 105 g |
| Johncryl 61 (an acryl-styrene based resin, manufactured by Johnson Co.) | 60 g |
| Glycerin | 100 g |
| Deionized water | 130 g |

were blended and the resultant mixture was dispersed employing a sand grinder which was filled with 0.5 mm zirconia beads at a volume ratio of 50 percent, whereby a magenta pigment dispersion was prepared.

An appropriate amount of ion-exchanged water was added into the resultant dispersion in order to adjust the concentration of anions in the ink as shown in following Table 1. Further, the resultant dispersion was passed through ion exchange resins. During said operation, the amount of said ion exchange resins was varied in order to adjust the resultant cation concentration as shown in Table 1.

The resultant deposits, which would have a negative effect on printing, were removed employing a centrifuge.

(Ink)

| | |
|---|---|
| Magenta pigment dispersion | 140 g |
| Nipol SX1105 (45 percent solids, manufactured by Nippon Zeon Co., Ltd.) | 56 g |
| Ethylene glycol | 150 g |
| Diethylene glycol | 120 g |
| Pelex OT-P (manufactured by Kao Corp.) | 4 g |
| Proxel GXL (manufactured by Zeneca Pharmaceuticals) | 2 g |

Sodium hydroxide added so that the pH of the finished ink was equaled to the value shown in Table 1

| | |
|---|---|
| Sodium dioctylsulfosuccinate (However, in the Comparative Example, sodium dioctylsulfosuccinate was not added) | 0.1 g |
| Potassium nitrate | 1.8 g |
| Deionized water to make | 1000 g |

The resultant mixture was well stirred and was then passed twice through a millipore filter filtering device, having a hole diameter of 1 micron.

The average particle diameter of the pigment in the resultant ink was 85 nm. The content ratio of particles having a particle diameter of at least 400 nm was 0.1 percent.

Oxygen Removal:

A hollow fiber using degas module comprised of oxygen-permeable membrane was subjected to pressure reduction and concentration of the dissolved oxygen was decreased by passing ink through said hollow fiber. The amount of dissolved oxygen was adjusted varying a passing rate of said ink as described in Table 1.

Measurement of Dissolved Oxygen

Ink was placed in a 100 ml beaker and said dissolved oxygen was measured employing dissolved oxygen meter DO-25A, manufactured by DK-TOA Corp.

Ink Ejection:

The above-prepared ink-jet heads and the inks ware combined and the ink was continuously ejected under conditions described in Examples 1 through 6 as well as in the Comparative Example shown in Table 1.

The working life of the head was determined as follows. When ink was not ejected from said head, it was cleaned or sucked. Ejection frequency was counted until said head did not recover even though it was subjected to such remedies.

A decrease in the ejection rate was determined as follows. The initial ejection rate and the ejection rate after 1 hour of operation were measured employing a camera, and the resultant difference was calculated. Table 2 shows the results.

TABLE 1

| | Insulating Layer Thickness (in $\mu$m) | Driving Frequency (in kHz) | Dissolved Oxygen (in ppm) | Ink pH | Total of Na and K (in ppm) | Total of $SO_4^{2-}$, $Cl^-$, and $NO_3^-$, (in ppm) | Surface Tension (in mN/m) |
|---|---|---|---|---|---|---|---|
| Comparative Example | 0.05 | 25 | 6 | 6.5 | 580 | 860 | 45 |
| Example 1 | 2.0 | 25 | 3.5 | 7.8 | 580 | 750 | 36 |
| Example 2 | 0.5 | 25 | 1.5 | 8.5 | 200 | 210 | 36 |
| Example 3 | 1.0 | 35 | 3.5 | 7.8 | 580 | 750 | 36 |
| Example 4 | 0.5 | 35 | 1.5 | 8.5 | 200 | 210 | 36 |
| Example 5 | 0.3 | 35 | 1.5 | 8.5 | 200 | 210 | 36 |
| Example 6 | 0.3 | 35 | 1.5 | 8.5 | 400 | 580 | 36 |

TABLE 2

| | Working Life of Head (× 100 million frequency) | Decrease in Ejection Rate |
|---|---|---|
| Comparative Example | 11 | 4 |
| Example 1 | 33 | 2 |
| Example 2 | 45 | 0 |
| Example 3 | 20 | 2.5 |
| Example 4 | 39 | 1 |
| Example 5 | 36 | 1 |
| Example 6 | 31 | 1.5 |

EFFECTS OF THE INVENTION

As can clearly seen form the above, according to the present invention, stable images can be formed over an extended period of time even at a high rate of operation.

What is claimed is:

1. An ink-jet recording method of forming an image with an ink-jet head, wherein the ink-jet head comprises an ink chamber, an electrode and an insulating layer for insulating the electrode from ink by covering the electrode, comprising steps of:

feeding ink containing a coloring material and a water-soluble solvent into the ink chamber; and applying a driving voltage with a driving frequency of 10 kHz to 55 kHz onto the electrode so that ink is jetted from the ink chamber so as to form the image;

wherein the thickness of the insulating layer is 0.1 $\mu$m to 10 $\mu$m and the concentration of oxygen dissolved in ink is 4 ppm or less.

2. The ink-jet recording method of claim 1, wherein the ink chamber contains a piezo element.

3. The ink-jet recording method of claim 2, wherein the electrode is provided on the piezo element.

4. The ink-jet recording method of claim 1, wherein pH of said ink is 7 or more.

5. The ink-jet recording method of claim 1, wherein said coloring material is a pigment.

6. The ink-jet recording method of claim 1, wherein the sum of a concentration of sulfate ion, chloride ion and nitrate ion in said ink is 500 ppm or less.

7. The ink-jet recording method of claim 1, wherein the sum of a concentration of sodium ion and potassium ion in said ink is 500 ppm or less.

8. The ink-jet recording method of claim 1, wherein said driving frequency is 20 kHz or more.

9. The ink-jet recording method of claim 8, wherein said driving frequency is 30 kHz or more.

10. The ink-jet recording method of claim 1, wherein a surface tension of said ink is from 31 to 39 mN/m.

11. The ink-jet recording method of claim 1, wherein the concentration of the dissolved oxygen in said ink is 2 ppm or less.

12. The ink-jet recording method of claim 1, wherein the concentration of the dissolved oxygen in said ink is 0.01 ppm or more.

13. The ink-jet recording method of claim 1, wherein the thickness of said insulating layer is from 0.1 to 5 $\mu$m.

14. The ink-jet recording method of claim 13, wherein the concentration of the dissolved oxygen in said ink is 2 ppm or less.

15. The ink-jet recording method of claim 1, wherein the electrode is provided in the ink chamber.

16. An ink-jet recording apparatus for forming an image, comprising:

an ink-jet head containing an ink chamber, an electrode, and an insulating layer for insulating the electrode from ink by covering the electrode, wherein the thickness of the insulating layer is 0.1 $\mu$m to 10 $\mu$m:

a driving section to apply a driving voltage onto the electrode with a driving frequency of 10 kHz to 55 kHz so that ink is jetted from the ink chamber so as to form the image; and an ink feeding section to feed the ink containing a coloring material and a water-soluble solvent into the ink chamber, wherein the concentration of oxygen dissolved in ink is 4 ppm or less.

17. The ink-jet recording apparatus of claim 16, wherein the ink chamber contains a piezo element.

18. The ink-jet recording apparatus of claim 16, wherein pH of said ink is 7 or more.

19. The ink-jet recording apparatus of claim 16, wherein said coloring material is a pigment.

20. The ink-jet recording apparatus of claim 16, wherein the sum of a concentration of sulfate ion, chloride ion and nitrate ion in said ink is 500 ppm or less.

21. The ink-jet recording apparatus of claim 16, wherein the sum of a concentration of sodium ion and potassium ion in said ink is 500 ppm or less.

22. The ink-jet recording apparatus of claim 16, wherein said driving frequency is 20 kHz or more.

23. The ink-jet recording apparatus of claim 22, wherein said driving frequency is 30 kHz or more.

24. The ink-jet recording apparatus of claim 16, wherein a surface tension of said ink is from 31 to 39 mN/m.

25. The ink-jet recording apparatus of claim 16, wherein the concentration of the dissolved oxygen in said ink is 2 ppm or less.

26. The ink-jet recording apparatus of claim 16, wherein the concentration of the dissolved oxygen of said ink is 0.01 ppm or more.

27. The ink-jet recording apparatus of claim 16, wherein the thickness of said insulating layer is from 0.1 to 5 $\mu$m.

* * * * *